US010874892B1

(12) United States Patent
Rowls

(10) Patent No.: US 10,874,892 B1
(45) Date of Patent: Dec. 29, 2020

(54) JUMP ROPE DEVICE

(71) Applicant: Joshua Rowls, Chicago, IL (US)

(72) Inventor: Joshua Rowls, Chicago, IL (US)

( * ) Notice: Subject to any disclaimer, the term of this patent is extended or adjusted under 35 U.S.C. 154(b) by 0 days.

(21) Appl. No.: 16/436,425

(22) Filed: Jun. 10, 2019

(51) Int. Cl.
*A63B 5/20* (2006.01)
*A63B 71/00* (2006.01)
*A63B 21/00* (2006.01)

(52) U.S. Cl.
CPC ..... *A63B 5/20* (2013.01); *A63B 21/4035* (2015.10); *A63B 71/0036* (2013.01); *A63B 2210/50* (2013.01)

(58) Field of Classification Search
CPC ..... A63B 5/20–205
See application file for complete search history.

(56) References Cited

U.S. PATENT DOCUMENTS 3,762,704 A 10/1973 Gingras
4,934,691 A 6/1990 Rudd
5,190,508 A 3/1993 Kliewer
6,544,149 B2 4/2003 O'Shea
6,752,746 B1 6/2004 Winkler
9,056,216 B1 6/2015 Bouza
9,884,218 B2 2/2018 Harguth
D821,509 S 6/2018 Ness
10,112,068 B2 * 10/2018 Medina ..... A63B 21/0555
2003/0148859 A1 8/2003 Chun
2010/0152002 A1 * 6/2010 Knight ..... A63B 21/0552 482/93
2010/0216608 A1 * 8/2010 Veitch ..... A63B 5/20 482/82
2017/0151457 A1 * 6/2017 Harguth ..... A63B 5/20

* cited by examiner

*Primary Examiner* — Jennifer Robertson

(57) ABSTRACT

A jump rope device providing a retractable, length adjustable rope includes a first handle, which is tubular, a second handle, a housing that defines an interior space, and a rope. The housing is coupled a first end of the first handle so that the first handle is fluidically coupled to the interior space. A retractor is coupled to the housing and is positioned in the interior space. The rope is coupled to and extends between the second handle and the retractor. The retractor is operationally coupled to the rope so that the retractor is positioned to selectively retract the rope into the interior space. The second handle is configured to be grasped in a hand of a user to extend the rope from the housing through a second end of the first handle so that the rope is configured to be used in a rope jumping maneuver.

8 Claims, 3 Drawing Sheets

JUMP ROPE DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relate to jump rope devices and more particularly pertain to a new jump rope device providing a retractable, length adjustable rope.

BRIEF SUMMARY OF THE INVENTION

An embodiment of the disclosure meets the needs presented above by generally comprising a first handle, which is tubular, a second handle, a housing that defines an interior space, and a rope. The housing is coupled a first end of the first handle so that the first handle is fluidically coupled to the interior space. A retractor is coupled to the housing and is positioned in the interior space. The rope is coupled to and extends between the second handle and the retractor. The retractor is operationally coupled to the rope so that the retractor is positioned to selectively retract the rope into the interior space. The second handle is configured to be grasped in a hand of a user to extend the rope from the housing through a second end of the first handle so that the rope is configured to be used in a rope jumping maneuver.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
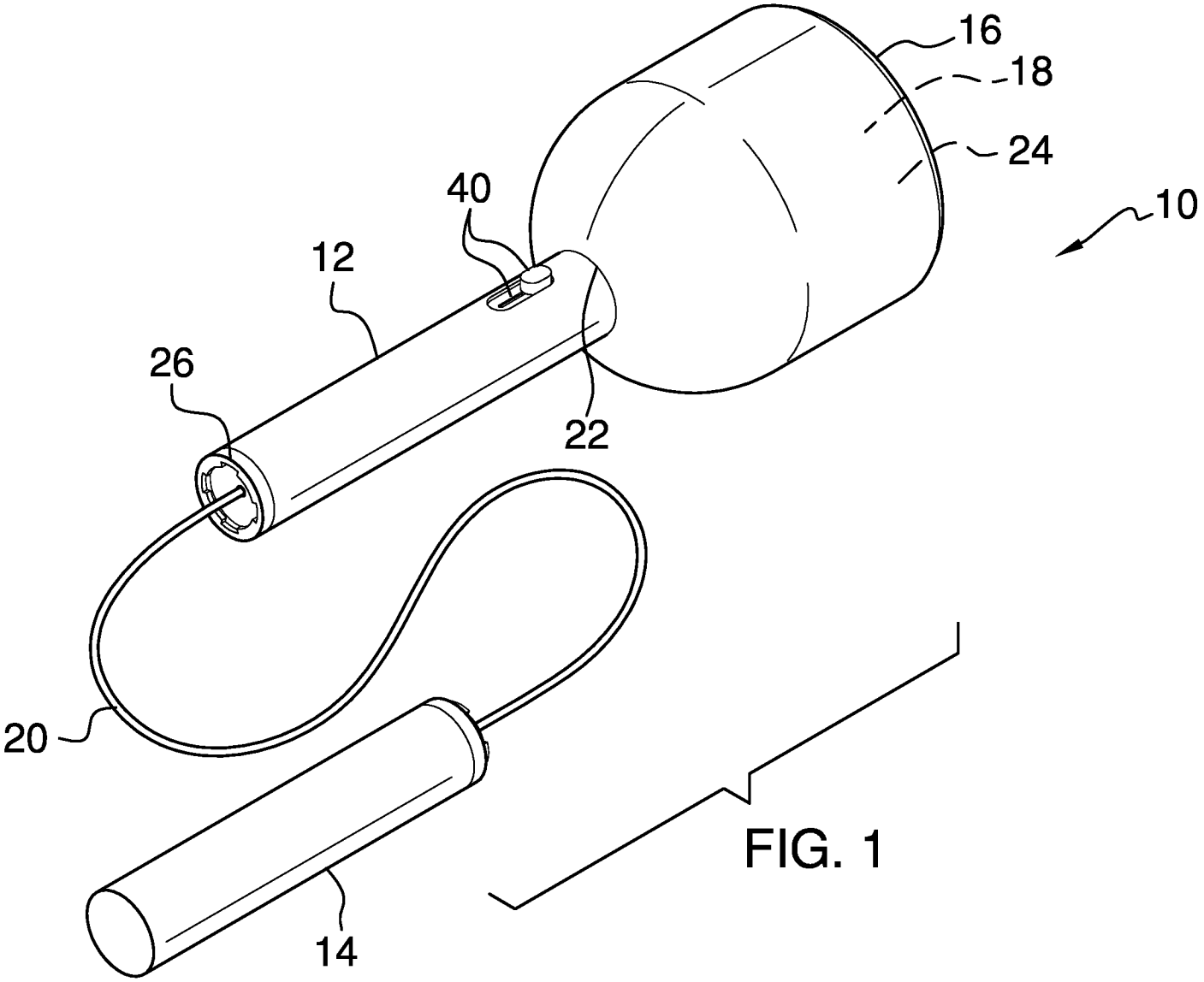
FIG. 1 is an isometric perspective view of a jump rope device according to an embodiment of the disclosure.
Figure 2:
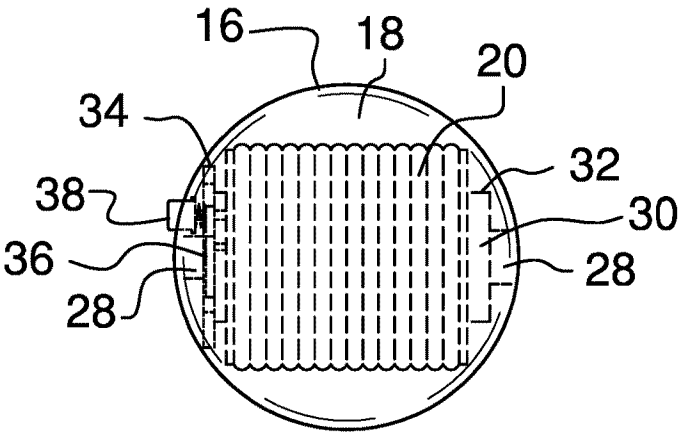
FIG. 2 is an end view of an embodiment of the disclosure.
Figure 3:
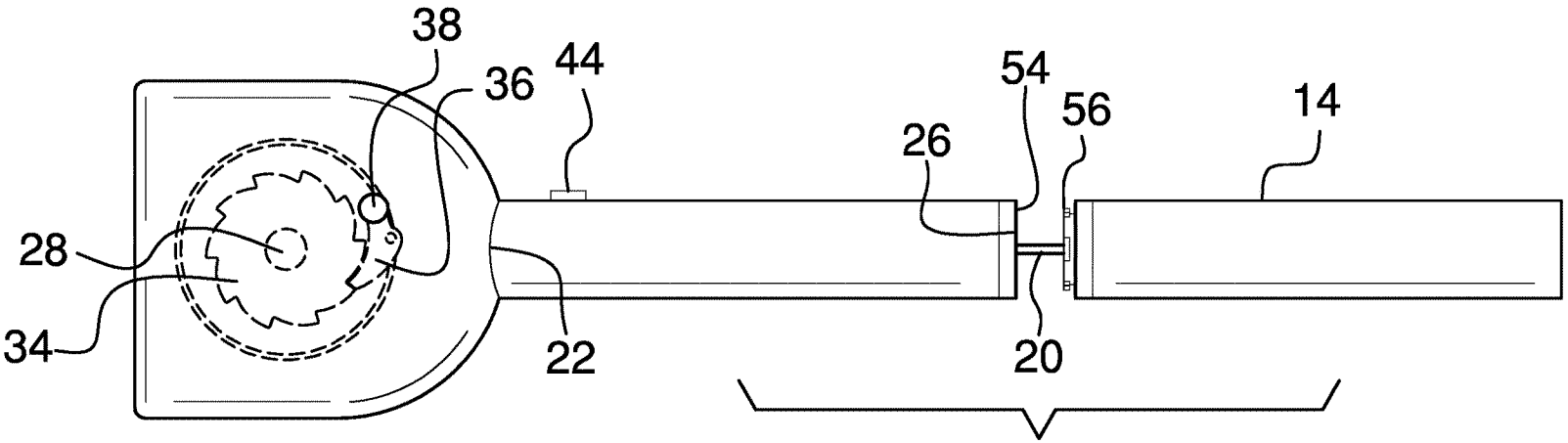
FIG. 3 is a side view of an embodiment of the disclosure.

With reference now to the drawings, and in particular to FIGS. 1 through 5 thereof, a new jump rope device embodying the principles and concepts of an embodiment of the disclosure and generally designated by the reference numeral 10 will be described.

As best illustrated in FIGS. 1 through 5, the jump rope device 10 generally comprises a first handle 12, which is tubular, a second handle 14, a housing 16 that defines an interior space 18, and a rope 20. The housing 16 is coupled to a first end 22 of the first handle 12 so that the first handle 12 is fluidically coupled to the interior space 18. A retractor 24 is coupled to the housing 16 and is positioned in the interior space 18. The housing 16 is substantially cylindrically shaped. The housing 16 is arcuate proximate to the first end 22 of the first handle 12 so that the housing 16 is circumferentially smaller proximate to the first handle 12.

The rope 20 is coupled to and extends between the second handle 14 and the retractor 24. The retractor 24 is operationally coupled to the rope 20 so that the retractor 24 is positioned to selectively retract the rope 20 into the interior space 18. The second handle 14 is configured to be grasped in a hand of a user to extend the rope 20 from the housing 16 through a second end 26 of the first handle 12 so that the rope 20 is configured to be used in a rope jumping maneuver. The rope 20 may be extended to a length suitable for a single user to use or may be further extended so that a first user grasping the first handle 12 and a second user grasping the second handle 14 are positioned to manipulate the rope 20 for jumping by one or more persons.

The retractor 24 comprises a shaft 28 that is positioned in the interior space 18 and which is rotationally coupled to the housing 16. That rope 20 is coupled to and is selectively loopedly positionable around the shaft 28.

A spring 30 is operationally coupled to the shaft 28. The spring 30 is coil type so that the spring 30 is configured to be tensioned as the rope 20 is uncoiled from the shaft 28 and extended from the housing 16. A shell 32 that is positioned around the spring 30 is positioned to retain the spring 30 in a coiled configuration around the shaft 28.

A ratchet wheel 34 is positioned in the interior space 18 and is coupled to the shaft 28. A pawl 36 is positioned in the interior space 18 and is pivotally coupled to the housing 16. The pawl 36 is selectively operationally couplable to the ratchet wheel 34 so that the pawl 36 is positioned to be disengaged from the ratchet wheel 34 to extend the rope 20 from the housing 16. A button 38 that is coupled to the housing 16 is depressible, spring loaded, and is operationally coupled to the pawl 36. The button 38 is configured to be depressed to disengage the pawl 36 from the ratchet wheel 34 so that the rope 20 is extensible from the housing 16 through the first handle 12.

A locking means 40 that is coupled to the first handle 12 is selectively couplable to the rope 20 to fixedly position the rope 20 within the first handle 12. The locking means 40 comprises a slot 42 that is positioned longitudinally in the first handle 12 proximate to the first end 22 of the first handle 12. A knob 44 is positioned in the slot 42 and extends radially from the housing 16 so that the knob 44 is positioned to slide within the slot 42. A cylinder 46 is coupled to the knob 44 and extends radially into the first handle 12. The cylinder 46 has a terminus 48, distal from the knob 44, that is tapered. A plate 50 is coupled to and is positioned in the first handle 12 so that the plate 50 is opposingly positioned relative to the slot 42. The plate 50 is tapered so that the plate 50 is complementary to the cylinder 46. The cylinder 46 and the plate 50 are positioned to frictionally couple to the rope 20 as the cylinder 46 is motived within the first handle 12 by sliding the knob 44 in the slot 42. A plurality of protuberances 52 that is coupled to and extends from the terminus 48 of the cylinder 46 is positioned to enhance frictional coupling of the cylinder 46 to the rope 20.

Figure 4:
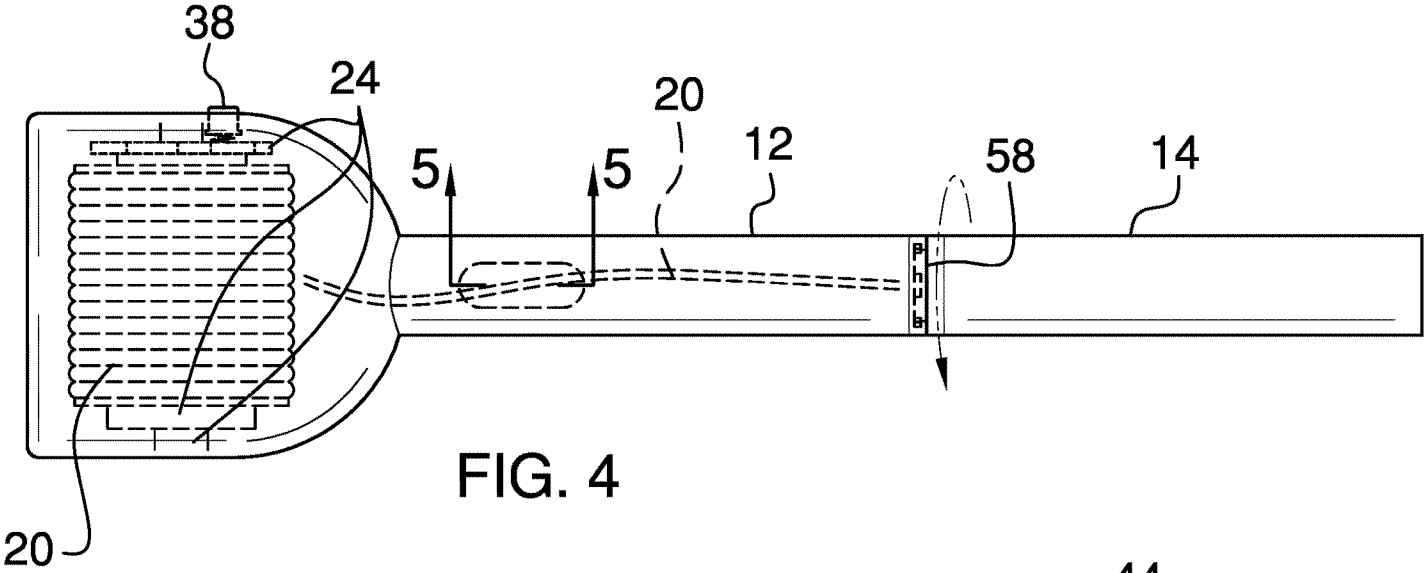
FIG. 4 is a bottom view of an embodiment of the disclosure.
Figure 5:
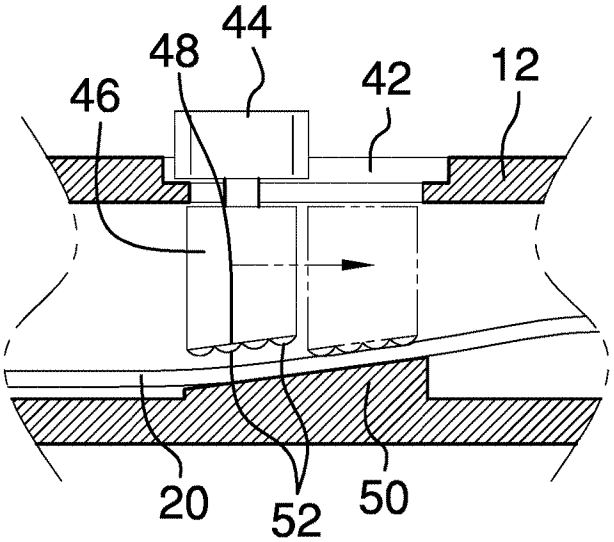
FIG. 5 is a cross-sectional view of an embodiment of the disclosure.

A first coupler 54 is coupled to the second end 26 of the first handle 12. A second coupler 56 is coupled to the second handle 14 proximate to the rope 20. The second coupler 56 is complementary to the first coupler 54 so that the second coupler 56 is positioned to selectively couple to the first coupler 54 to removably couple the second handle 14 to the first handle 12, with the second handle 14 and the first handle 12 being substantially colinear. The second coupler 56 and the first coupler 54 may comprise a twist lock connector 58, as shown in FIG. 4, or other type of releasable fastener such as, but not limited to, a quick connector and the like.

In use, the button 38 is depressed to disengage the pawl 36 from the ratchet wheel 34 so that the rope 20 is extensible from the housing 16 through the first handle 12 concurrent with tensioning of the spring 30. When the rope 20 is extended to a desired length, the knob 44 is slid in the slot 42 so that the rope 20 is fixedly positioned in the first handle 12 by the cylinder 46 and the plate 50. To stow the rope 20, the knob 44 is slid the other direction to release the rope 20, which is retracted into the housing 16 by action of the spring 30 rotating the shaft 28. The second handle 14 then is positioned to be coupled to the first handle 12 using the twist lock connector 58.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

I claim:

1. A jump rope device comprising:

a first handle and a second handle, the first handle being tubular;

a housing defining an interior space, the housing being coupled a first end of the first handle such that the first handle is fluidically coupled to the interior space;

a retractor coupled to the housing and positioned in the interior space; and a rope coupled to and extending between the second handle and the retractor, the retractor being operationally coupled to the rope such that the retractor is positioned for selectively retracting the rope into the interior space wherein the second handle is configured for grasping in a hand of a user for extending the rope from the housing through a second end of the first handle wherein the rope is configured for use in a rope jumping maneuver; and a locking means coupled to the first handle, the locking means being selectively couplable to the rope for fixedly positioning the rope within the first handle, the locking means comprising a slot positioned longitudinally in the first handle proximate to the first end of the first handle, a knob positioned in the slot and extending radially from the housing such that the knob is positioned for sliding within the slot, a cylinder coupled to the knob and extending radially into the first handle, the cylinder having a terminus distal from the knob, the terminus being tapered, and a plate coupled to and positioned in the first handle such that the plate is opposingly positioned relative to the slot, the plate being tapered such that the plate is complementary to the cylinder such that the cylinder and the plate are positioned for frictionally coupling to the rope as the cylinder is motived within the first handle by sliding of the knob in the slot.

2. The device of claim 1, further including the housing being substantially cylindrically shaped.

3. The device of claim 2, further including the housing being arcuate proximate to the first end of the first handle.

4. The device of claim 1, further including the retractor comprising:

a shaft positioned in the interior space and rotationally coupled to the housing, that rope being coupled to and selectively loopedly positionable around the shaft;

a spring operationally coupled to the shaft, the spring being coil type wherein the spring is configured for tensioning as the rope is uncoiled from the shaft and extended from the housing;

a shell positioned around the spring such that the shell is positioned for retaining the spring in a coiled configuration around the shaft;

a ratchet wheel positioned in the interior space and coupled to the shaft;

a pawl positioned in the interior space and pivotally coupled to the housing, the pawl being selectively operationally couplable to the ratchet wheel such that the pawl is positioned for disengaging from the ratchet wheel for extending the rope from the housing; and a button coupled to the housing, the button being depressible, the button being spring loaded, the button being operationally coupled to the pawl wherein the button is configured for depressing for disengaging the pawl from the ratchet wheel such that the rope is extensible from the housing through the first handle.

5. The device of claim 1, further including a plurality of protuberances coupled to and extending from the terminus of the cylinder such that the protuberances are positioned for enhancing frictional coupling of the cylinder to the rope.

6. The device of claim 1, further comprising:

a first coupler coupled to the second end of the first handle; and a second coupler coupled to the second handle proximate to the rope, the second coupler being complementary to the first coupler such that the second coupler is positioned for selectively coupling to the first coupler for removably coupling the second handle to the first handle such that the second handle and the first handle are substantially colinear.

7. The device of claim 6, further including the second coupler and the first coupler comprising a twist lock connector.

8. A jump rope device comprising:

a first handle and a second handle, the first handle being tubular;

a housing defining an interior space, the housing being coupled a first end of the first handle such that the first handle is fluidically coupled to the interior space, the housing being substantially cylindrically shaped, the housing being arcuate proximate to the first end of the first handle;

a rope coupled to and extending between the second handle and a retractor coupled to the housing and positioned in the interior space, the retractor being operationally coupled to the rope such that the retractor is positioned for selectively retracting the rope into the interior space wherein the second handle is configured for grasping in a hand of a user for extending the rope from the housing through a second end of the first handle wherein the rope is configured for use in a rope jumping maneuver, the retractor comprising:

a shaft positioned in the interior space and rotationally coupled to the housing, that rope being coupled to and selectively loopedly positionable around the shaft, a spring operationally coupled to the shaft, the spring being coil type wherein the spring is configured for tensioning as the rope is uncoiled from the shaft and extended from the housing, a shell positioned around the spring such that the shell is positioned for retaining the spring in a coiled configuration around the shaft, a ratchet wheel positioned in the interior space and coupled to the shaft, a pawl positioned in the interior space and pivotally coupled to the housing, the pawl being selectively operationally couplable to the ratchet wheel such that the pawl is positioned for disengaging from the ratchet wheel for extending the rope from the housing, and a button coupled to the housing, the button being depressible, the button being spring loaded, the button being operationally coupled to the pawl wherein the button is configured for depressing for disengaging the pawl from the ratchet wheel such that the rope is extensible from the housing through the first handle;

a locking means coupled to the first handle, the locking means being selectively couplable to the rope for fixedly positioning the rope within the first handle, the locking means comprising:

a slot positioned longitudinally in the first handle proximate to the first end of the first handle, a knob positioned in the slot and extending radially from the housing such that the knob is positioned for sliding within the slot, a cylinder coupled to the knob and extending radially into the first handle, the cylinder having a terminus distal from the knob, the terminus being tapered, a plate coupled to and positioned in the first handle such that the plate is opposingly positioned relative to the slot, the plate being tapered such that the plate is complementary to the cylinder such that the cylinder and the plate are positioned for frictionally coupling to the rope as the cylinder is motived within the first handle by sliding of the knob in the slot, and a plurality of protuberances coupled to and extending from the terminus of the cylinder such that the protuberances are positioned for enhancing frictional coupling of the cylinder to the rope;

a first coupler coupled to the second end of the first handle; and a second coupler coupled to the second handle proximate to the rope, the second coupler being complementary to the first coupler such that the second coupler is positioned for selectively coupling to the first coupler for removably coupling the second handle to the first handle such that the second handle and the first handle are substantially colinear, the second coupler and the first coupler comprising a twist lock connector.

* * * * *